US009073673B2

(12) United States Patent
Mazurkiewicz et al.

(10) Patent No.: US 9,073,673 B2
(45) Date of Patent: Jul. 7, 2015

(54) CLOSURE FOR AN INVERTED CONTAINER

(75) Inventors: Timothy M. Mazurkiewicz, Milwaukee, WI (US); Stacy L. Beilke, Eagle, WI (US); Anne F. Stecker, Arvada, CO (US); John Wisniewski, Wauwatosa, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 13/639,603

(22) PCT Filed: Apr. 13, 2010

(86) PCT No.: PCT/US2010/001092

§ 371 (c)(1),
(2), (4) Date: Oct. 5, 2012

(87) PCT Pub. No.: WO2011/129798

PCT Pub. Date: Oct. 20, 2011

(65) Prior Publication Data

US 2013/0026168 A1 Jan. 31, 2013

(51) Int. Cl.

| | |
|---|---|
| ***B65D 47/20*** | (2006.01) |
| ***B65D 47/08*** | (2006.01) |
| ***B65D 51/24*** | (2006.01) |

(52) U.S. Cl.

CPC ..... *B65D 47/2031* (2013.01); *B65D 47/0814* (2013.01); *B65D 51/249* (2013.01); *B65D 2251/1066* (2013.01)

(58) Field of Classification Search

CPC ..... B65D 43/162; B65D 47/06; B65D 47/08; B65D 47/0809; B65D 47/0838; B65D 47/0814

USPC ..... 215/235; 220/254.1, 254.3, 839; 222/546, 556, 562, 563

See application file for complete search history.

(56) References Cited

U.S. PATENT DOCUMENTS

| | | | | |
|---|---|---|---|---|
| 3,604,585 | A | 9/1971 | Towns | |
| 4,457,458 | A * | 7/1984 | Heinol | 222/498 |

(Continued)

FOREIGN PATENT DOCUMENTS

| | | | |
|---|---|---|---|
| EP | 0575764 | A1 | 5/1993 |
| WO | WO 2007/136499 | A1 | 11/2007 |
| WO | 2007145831 | A2 | 12/2007 |

OTHER PUBLICATIONS

International Search Report (Form PCT/ISA/210) for PCT/US2010/01092.

*Primary Examiner* — Anthony Stashick
*Assistant Examiner* — Kaushikkumar Desai
(74) *Attorney, Agent, or Firm* — Wood, Phillips, Katz, Clark & Mortimer

(57) ABSTRACT

A closure (30) is provided for a container (32). In one particular embodiment, the closure (30) has a base (34) and a lid (36). The base (34) defines a recess (70) having a dispensing orifice (74). On either side of the recess (70), the base (34) has a rim portion (80) that defines a support surface (82). The front region of the base (34) has a sloping front surface (72). The lid (36) has a rear end connected with a connecting structure (40) to the closure base (34), and has a front end with a lid finger lift surface (86). When the lid (36) is closed, the front end of the lid (36) is located rearwardly of at least the lower end of the base sloping front surface (72), a major portion of the lid (36) is located between the base rim portions (80), and the lid (36) is located below the support surface (82) of each rim portion (80).

9 Claims, 9 Drawing Sheets

(56) References Cited

U.S. PATENT DOCUMENTS

| | | | | |
|---|---|---|---|---|
| 5,007,555 | A * | 4/1991 | Beck | 220/254.3 |
| D328,246 | S | 7/1992 | Nottingham | |
| 5,201,440 | A * | 4/1993 | Gross | 222/153.07 |
| D356,499 | S * | 3/1995 | Cautereels et al. | D9/449 |
| D356,949 | S | 4/1995 | Mueller et al. | |
| 5,409,144 | A | 4/1995 | Brown | |
| 5,769,253 | A | 6/1998 | Gross | |
| 5,797,523 | A | 8/1998 | Gross | |
| 6,039,197 | A * | 3/2000 | Braun | 215/228 |
| 6,364,101 | B1 | 4/2002 | Schultz | |
| 6,371,316 | B1 | 4/2002 | Herr et al. | |
| 6,478,184 | B2 * | 11/2002 | Berge et al. | 220/831 |
| 6,554,156 | B1 | 4/2003 | Chong | |
| 6,616,016 | B2 | 9/2003 | Hicks et al. | |
| 7,121,438 | B2 | 10/2006 | Hoepner et al. | |
| D609,093 | S | 2/2010 | Wisniewski et al. | |
| D627,640 | S | 11/2010 | Mazurkiewicz et al. | |
| D627,641 | S | 11/2010 | Mazurkiewicz et al. | |
| D627,642 | S | 11/2010 | Mazurkiewicz et al. | |
| 2007/0267451 | A1 | 11/2007 | Robinson | |
| 2007/0289936 | A1 | 12/2007 | Pugne | |
| 2008/0073311 | A1 * | 3/2008 | Jelich et al. | 215/305 |
| 2008/0290105 | A1 | 11/2008 | Robinson | |

* cited by examiner

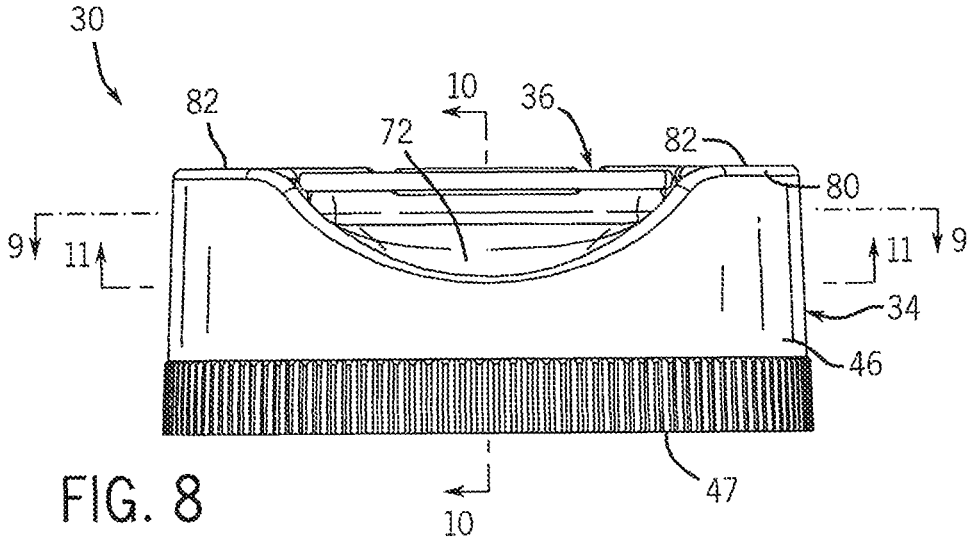
FIG. 8
FIG. 9
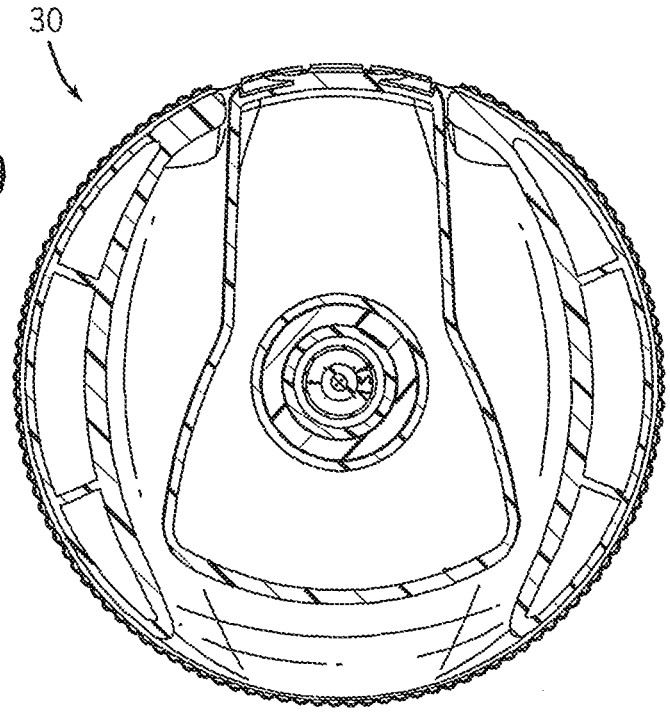

CLOSURE FOR AN INVERTED CONTAINER

TECHNICAL FIELD

This invention relates to a closure for a container wherein the closure has a lid that can be opened to provide access to the container contents.

BACKGROUND OF THE INVENTION AND TECHNICAL PROBLEMS POSED BY THE PRIOR ART

Closures are typically used for facilitating the containment of, and permitting access to, a product stored in a container. There are a variety of types of conventional closures for containers. One type of prior art closure includes a body or base for being attached to the top of a container. The base defines an opening to the container interior. The closure further includes a lid which is hingedly mounted on the base and which can be lifted up to expose the closure base opening.

The inventor of the present invention has discovered that some closures molded from thermoplastic material have higher cost designs because of the greater amount of plastic material required. Also, some closures require a greater number of, or more complex, latching features for securely latching the lid closed on the closure base.

A typical conventional closure base and lid are adapted to "latch together" when the lid is in the closed position on the closure base. One typical type of such a latching system includes a laterally outwardly extending latch bead on a portion of the closure base and a laterally inwardly extending latch bead on a portion of the closure lid so that when the lid is in the closed position on top of, and at least partly overlapping a portion of the closure base, the lid latch bead lies below the closure base latch bead to create an interference resistance to opening the lid.

Typically, the closed lid must be initially subjected to an upwardly directed force applied by the user so as to effect sufficient temporary, elastic distortion or deformation of the closure lid and/or closure base in the region of the lid latch bead and closure base latch bead to permit the lid latch bead to be forced upwardly past, and become free of, the closure base latch bead. Thereafter, only a much reduced lift force is needed to continue moving the lid further upwardly to a fully opened (or at least sufficiently opened) position.

A manufacturer of a product may sell the product in a package consisting of a container in which the product is stored and on which the closure is installed. The inventor of the present invention has noticed that with some container/closure packages, the packages may be subjected to unintended, inadvertent, accidental impacts from, or engagements with, external structures or adjacent packages, and such impacts or engagements can overcome the latching resistance and dislodge the fully closed lid.

The inventor of the present invention has noticed that such lid-opening or lid-loosening impacts or engagements can occur during handling or shipping of the package by the manufacture of the product (especially when many identical packages are loaded together in a shipping carton or other transport device and subjected to shaking, bouncing, etc., during transportation). The inadvertent impacts caused during shipping may cause one or more package lids to become opened, or partially opened, or loose.

Some container/closure packages may be stored in an "inverted" orientation by the user. In such an inverted orientation, the container is supported by the closure which is at the bottom. During initial placement of the package in the inverted orientation, as well as during subsequent storage in the inverted orientation, the closure may be subjected to forces that could lead to an unintentional opening of the lid, or to loosening of the lid.

Another problem can occur when a user opens a closure lid and subsequently dispenses, or otherwise removes, some of the product from the container. Small quantities of the product may flow onto, drop onto, or otherwise contact a surface of the closure base. Over time, this can remain as an undesirable accumulation. The user may have difficulty in readily removing such accumulation from portions of the closure base.

The inventor of the present invention has discovered how to provide an improved closure which can accommodate designs that minimize, if not eliminate, one or more of the above-discussed problems. Further, such an improved closure can be designed to accommodate efficient, high-quality, high-speed, large volume manufacturing techniques with a reduced product reject rate to produce products having consistent operating characteristics unit-to-unit with high reliability.

BRIEF SUMMARY

According to one aspect of the present invention, an improved closure is provided for being mounted to, or formed as a unitary part of, a container that has an opening to the container interior where a product may be stored.

The closure has a body or base that is either (A) separate from said container for being attached to the container at the opening, or (B) a structure formed as a unitary portion of the container at the opening. The base defines at least one dispensing orifice for communicating with the container opening.

The closure also has a lid and also has a connecting structure connecting the lid to the base for movement between (A) a closed position occluding the dispensing orifice, and (B) an open position spaced from the dispensing orifice.

The base also includes the following features:

(1) has a peripheral skirt extending to a bottom edge, (2) has a recess that extends in the base from the connecting structure to a front region of the base, (3) defines a sloping front surface that (a) is located at the front region of the base, and (b) slopes in the direction toward the base bottom edge, (4) defines the dispensing orifice between the connecting structure and the base sloping front surface, and (5) has two spaced-apart rim portions, wherein one of the rim portions is located on one side of the base recess between the connecting structure and the sloping front surface, wherein the other of the rim portions is located on the other side of the recess between the connecting structure and the sloping front surface, and wherein each rim portion has a support surface for supporting the closure while installed on the container when the closure and container are in an inverted orientation.

The lid also:

(1) has a rear end attached to the connecting structure, (2) has a front end defining a lid finger lift surface against which a user can apply a force to lift the lid, and (3) is positioned in the recess when the closure is installed on a container in an upright orientation with the closure at the top of the container and with the lid in the closed position so that (a) the lid is below the support surface of each the two spaced-apart rim portions of the base, (b) the lid front end is located rearwardly of at least a lower end of the base sloping front surface, and (c) a major portion of the lid is located laterally between the two spaced-apart rim portions of the base.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 8 is a front elevational view of the closed closure shown in FIG. 4;

FIG. 9 is a cross-sectional view taken generally along the plane 9-9 in FIG. 8;

DESCRIPTION OF THE PREFERRED EMBODIMENTS

While this invention is susceptible of embodiment in many different forms, the accompanying drawings illustrate only one specific form as an example, of the invention that is presently believed to be the best mode. The specification describes the one illustrated embodiment, and also describes various alternate embodiments or variations. The invention is not intended to be limited to the embodiments so described, and the scope of the invention will be pointed out in the appended claims.

For ease of description, the illustrated embodiment of the closure that incorporates aspects of this invention is described in particular orientations, and terms such as upper, lower, horizontal, etc., are used with reference to these orientations. It will be understood, however, that the closure may be manufactured, stored, and used in orientations other than the ones described.

The closure of this invention is suitable for use with a variety of conventional or special containers having various designs, the details of which, although not illustrated or described, would be apparent to those having skill in the art and an understanding of such containers. With respect to the embodiments of the invention described herein, the container, per se, forms no part of, and therefore is not intended to limit, the broadest aspects of the present invention. It will also be understood by those of ordinary skill that novel and non-obvious inventive aspects are embodied in the described exemplary closure alone.

Figure 1:
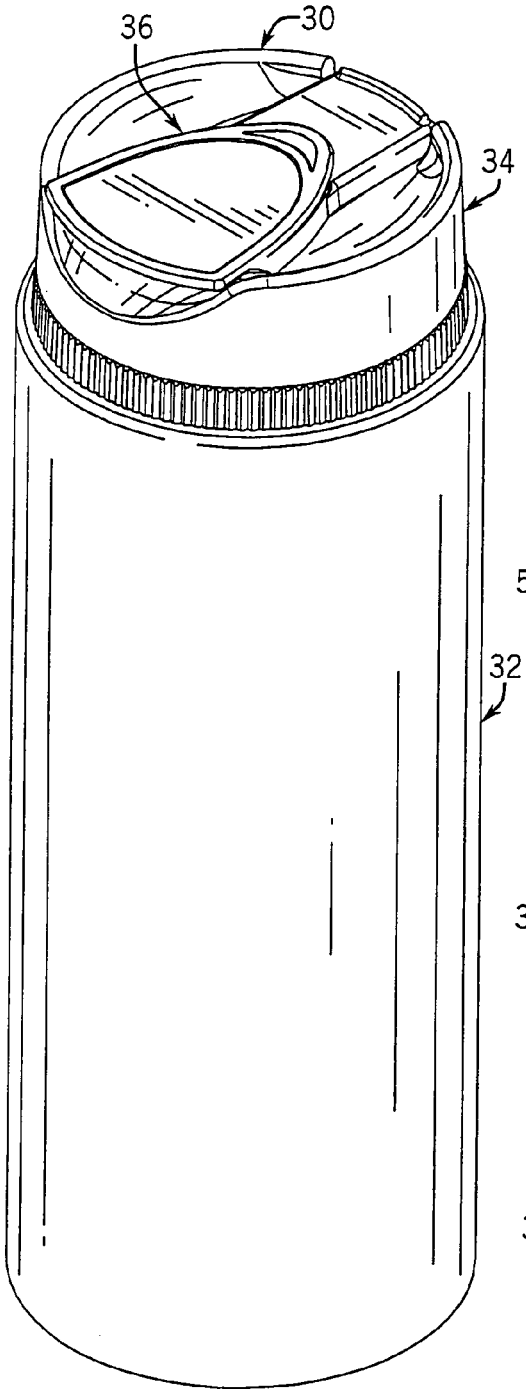
FIG. 1 is an isometric view of an embodiment of a closure of the present invention in the form of a separate closure which has been installed on a container, and the closure shown in a closed condition.

One embodiment of a closure of the present invention is in the form of a dispensing closure illustrated in FIGS. 1-14 and is designated generally in some of those figures by reference number 30. In the illustrated embodiment, the dispensing closure 30 is provided as a separately manufactured article, component, or unit for being removably, or non-removably, installed (e.g., mounted) on a previously manufactured container 32 (FIGS. 1-3) that has an opening to the container interior. It will be appreciated, however, that in some applications (not illustrated), it may be desirable for the closure 30 (or at least a base portion of the closure 30) to be formed as a unitary part, or extension, of the container wherein such a unitary part or extension defines an end structure of the container, per se.

The container 32 typically has a conventional mouth (not visible) which provides access to the container interior and to a product contained therein. The product may be, for example, a fluent material such as a flowable liquid, cream, or paste-type food product or non-food product that can be poured out or squeezed out. The product could also be pieces of material (e.g., food products such as nuts, candies, crackers, cookies, etc. or non-food products including various particles, granules, etc.), which can be removed by hand from a container, or scooped out of a container, or ladled out of a container. The product may also be a fluent material that can be poured, as well as scooped out, or ladled out, such as ground coffee, sugar, or other material, such as powders, slurries, etc. Such materials may be sold, for example, as a food product, a personal care product, an industrial product, a household product, or other types of products. Such materials may be for internal or external use by humans or animals, or for other uses (e.g., activities involving medicine, manufacturing, commercial or household maintenance, construction, agriculture, etc.).

The container 32 typically may include a neck (not visible) or other suitable structure that defines the container mouth or opening and that has a cross-sectional configuration with which the closure 30 is adapted to engage. The main body portion of the container 32 may have another cross-sectional configuration that differs from the cross-sectional configuration of the container neck or mouth. The container 32 may, on the other hand, have a substantially uniform shape along its entire length or height without any neck portion of reduced size or different cross-section.

The container 32 may or may not be a rigid container having a generally rigid or flexible wall or walls which can be grasped by the user. However, the particular embodiment of the closure 30 illustrated in FIGS. 1-14 is especially suitable for use with a container 32 that has a substantially flexible wall that can be squeezed or deflected laterally inwardly by the user to increase the internal pressure within the container 32 so as to force the product out of the container 32 and through the opened closure. Such a flexible container wall typically has sufficient, inherent resiliency so that when the squeezing forces are removed, the container wall returns to its normal, unstressed shape. Such a squeezable container is preferred in many applications but may not be necessary or preferred in other applications. For example, in some applications it may be desirable to employ a generally rigid container, and to pressurize the container interior at selected times with a piston or other pressurizing system, or to reduce the exterior ambient pressure so as to suck the material out through the open closure. On the other hand, if the closure has a suitably large dispensing orifice, then the closure can be used on a rigid container from which the contents (e.g., the product) can be accessed through the open closure by pouring or scooping out the contents.

Figure 5:
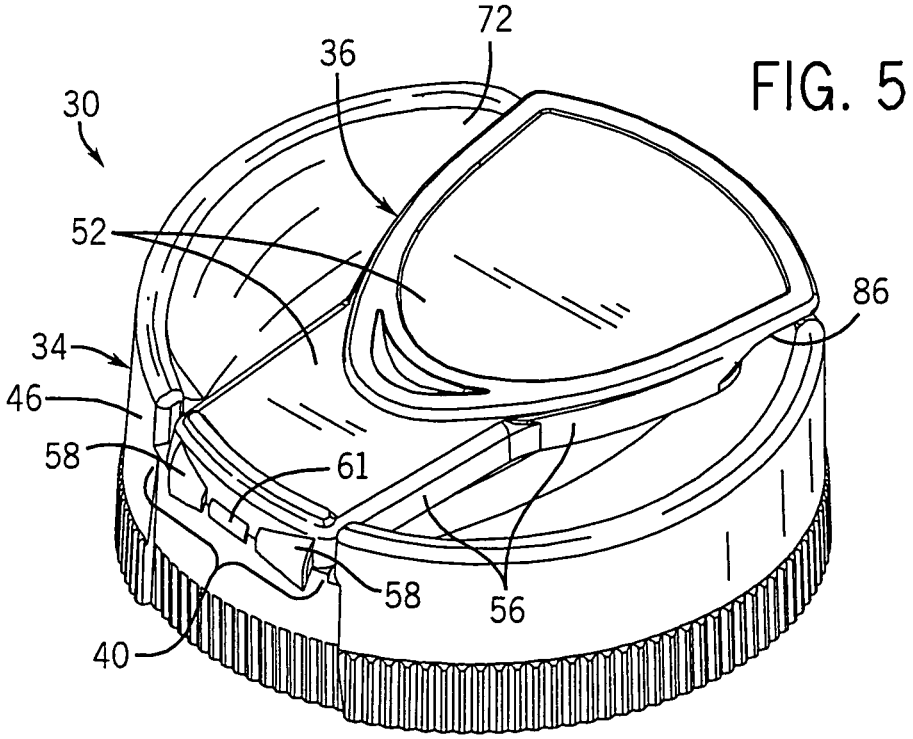
FIG. 5 is an isometric view of the closure shown in FIG. 4, but in FIG. 5 the closure is shown from the rear.

As can be seen in FIG. 5, the closure 30 includes a body or base 34 and a lid 36 connected to the body or base 34 with a connecting structure 40. Throughout this specification, the terms "body" and "base" will be used interchangeably. The body or base 34 includes an exterior skirt 46 (FIG. 10) having a bottom edge 47, and includes an internal collar 48 (FIG. 10) which has a conventional, internal, female thread 50 for engaging a suitable cooperating external thread (not shown) on the container 32, so as to secure the closure base 34 to the container 32. Alternatively, a snap-fit bead connection system (not illustrated) could be used. In another optional design (not illustrated), the closure internal collar 48 could be omitted altogether, and the exterior skirt 46 could be configured and sized for mounting directly on, and attaching to, the container 32. The closure base 34 could also be permanently attached to the container 32 by means of induction bonding, ultrasonic bonding, gluing, or the like, depending upon the materials employed for the container 32 and closure base 34.

In the illustrated embodiment, the closure base 34, lid 36, and connecting structure 40 are molded as a unitary structure from a suitable thermoplastic material such as polypropylene or the like. Other materials may be employed instead.

In other contemplated embodiments (not illustrated), the closure 30 need not be a structure that is completely separate from the container. Instead, the container 32 could be made with a dispensing end structure that incorporates the closure 30 as a unitary part of the container 32. In such an alternative, the illustrated closure 30 could be modified so that the closure base 34 is formed as an extension of the container 32, per se, and such an extending portion defining the closure base 34 could then be characterized as a structural feature that functions to (1) accommodate communication with the container interior, and (2) cooperate with the lid 36.

In either of the above-discussed alternatives (i.e., either a separate closure 30 or a closure having a closure base molded as an extension of a container 32), the container may have an initially open bottom end opposite the end on which the closure 30 is located, and such an initially open bottom end could be used for accommodating the filling of the container with the product (after inverting the container). After the inverted container is filled with the product through the open bottom end of the container, the open bottom end of the container could be closed by suitable means, such as by a separate bottom end closure which could be attached to the container bottom end (e.g., through a suitable threaded engagement, snap-fit engagement, adhesive engagement, thermal bonding engagement, etc.). Alternatively, such an open bottom end of the container could be deformed closed (e.g., with an appropriate process applying heat and force if the container bottom end portion is made from a thermoplastic material or other material that would accommodate the use of such a process).

The interior of the closure base 34 may also include special or conventional seal features to provide an enhanced leak-tight seal between the closure base 34 and the container 32. The illustrated threaded closure body 34 does not employ such an enhanced seal feature.

Figure 7:
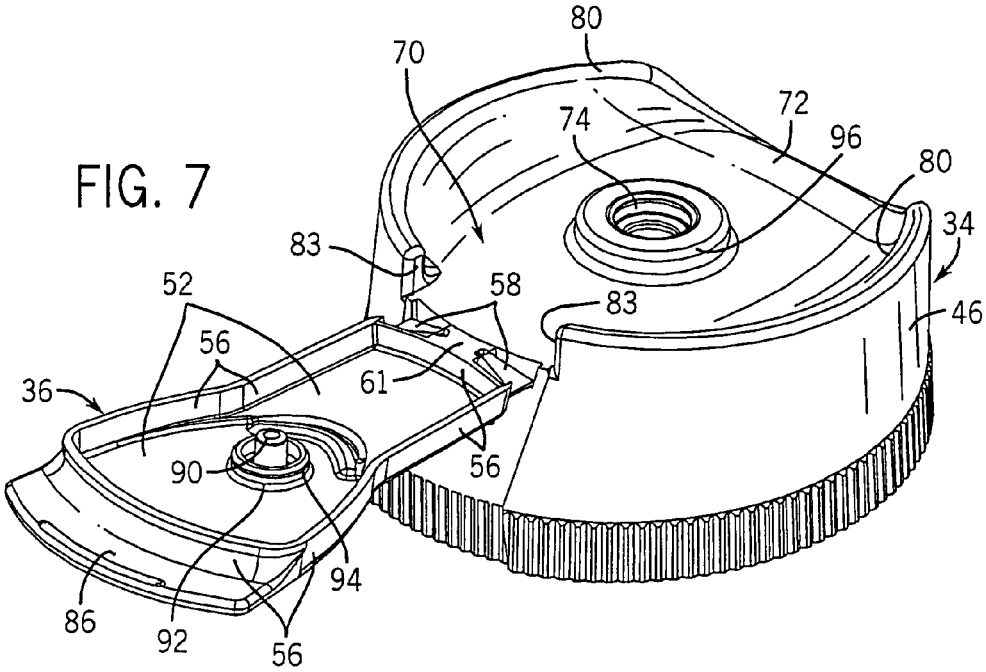
FIG. 7 is an isometric view similar to FIG. 6, but in FIG. 7 the open closure is shown from the rear.
Figure 10:
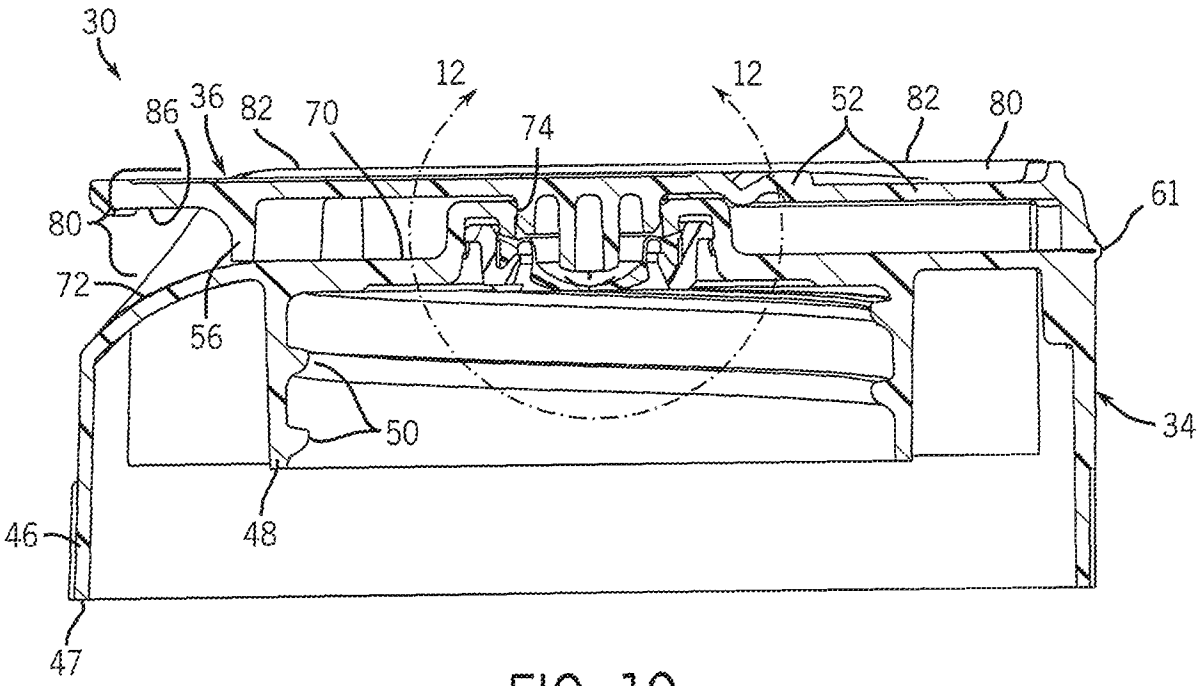
FIG. 10 is an enlarged, cross-sectional view taken generally along the plane 10-10 in FIG. 8.
Figure 11:
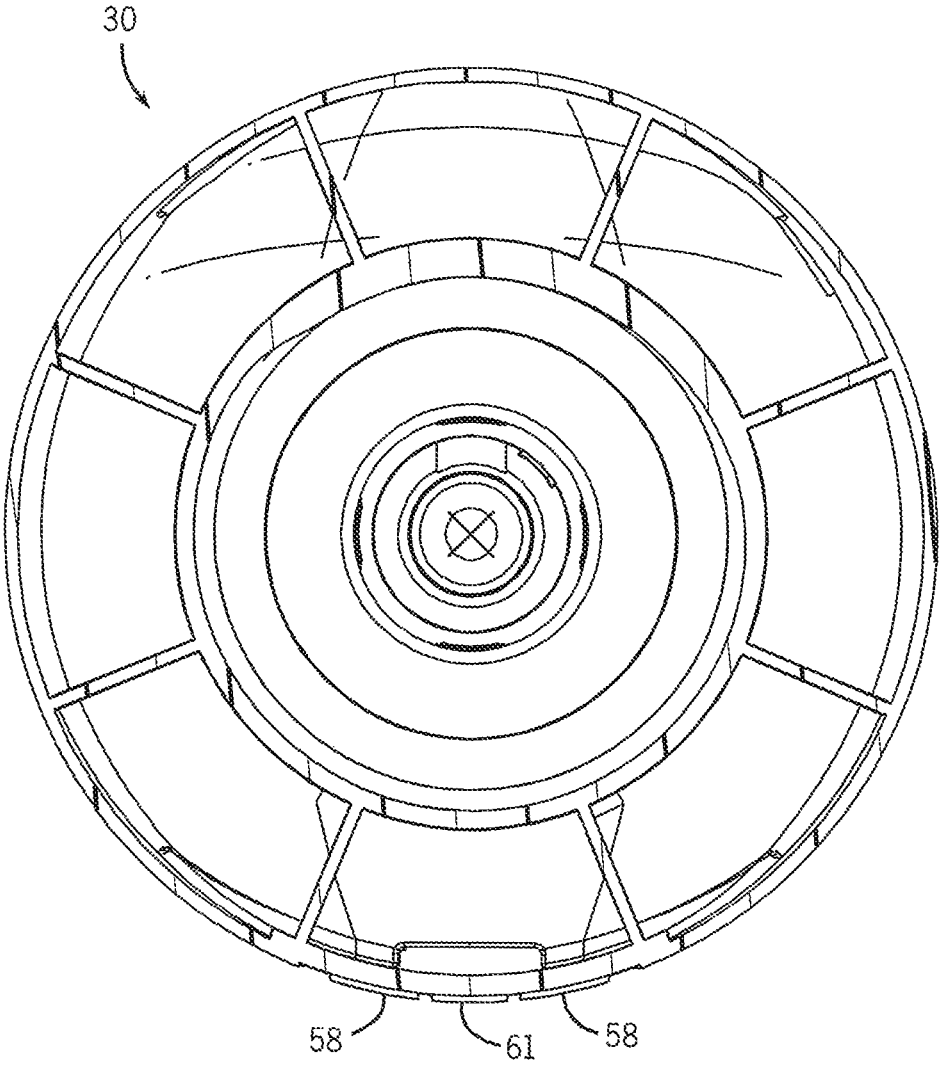
FIG. 11 is an enlarged, cross-sectional view taken generally along the plane 11-11 in FIG. 8.
Figure 13:
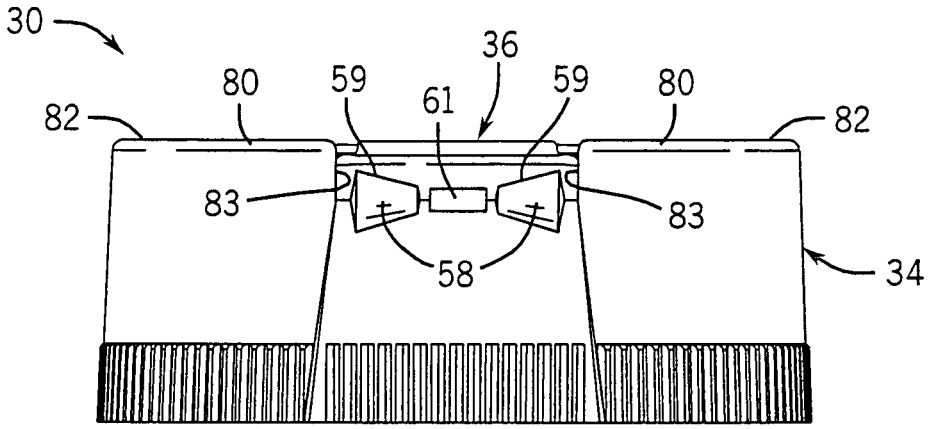
FIG. 13 is a rear elevational view of the closed closure.
Figure 14:
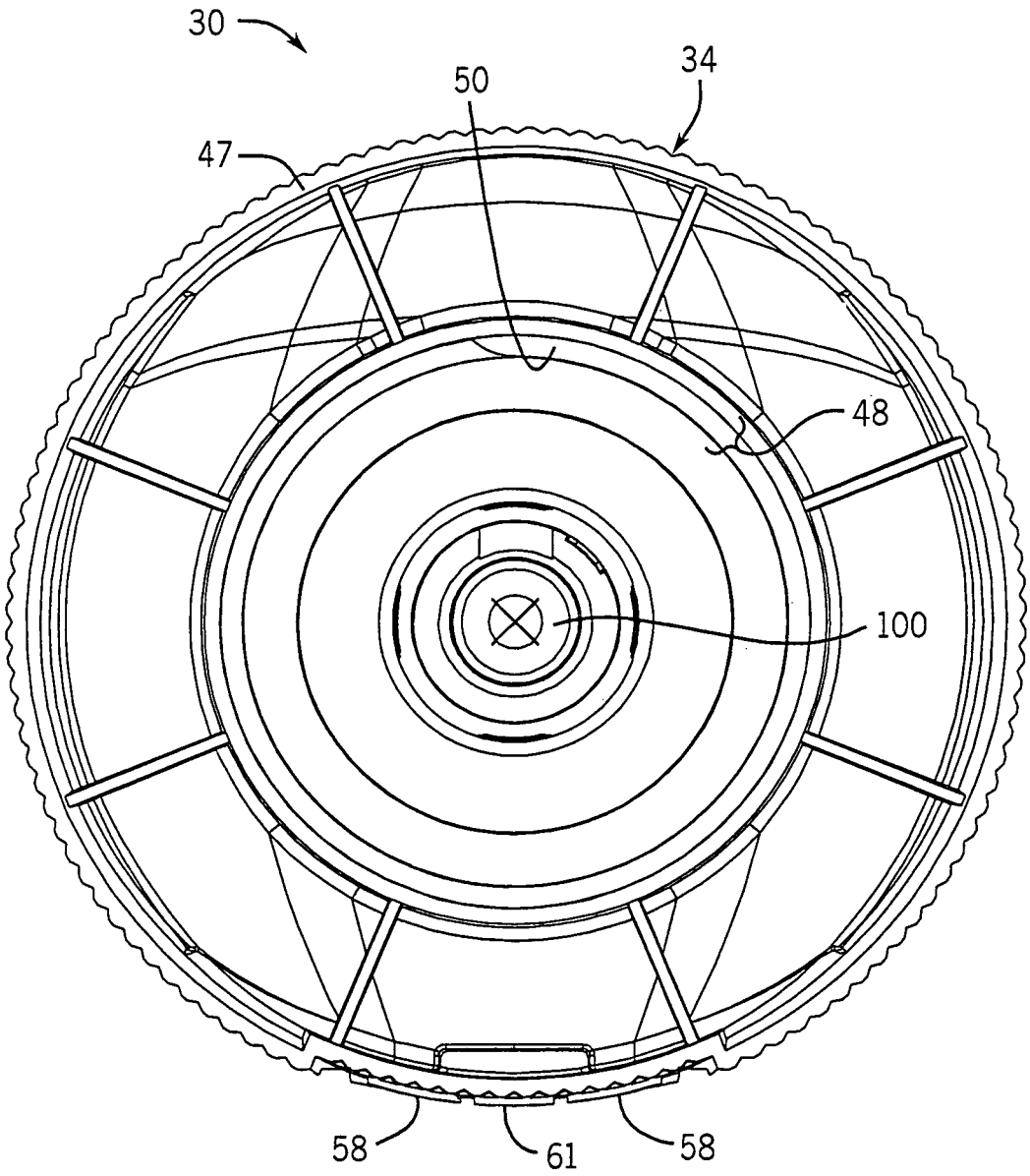
FIG. 14 is a bottom plan view of the closed closure.

With reference to FIGS. 5 and 7, the lid 36 has a top cover portion 52 surrounded by a depending peripheral wall or flange 56. The lid top cover portion 52 and flange 56 are joined to the connecting structure 40. In particular, the connecting structure 40 may be of any suitable conventional design known in the closure art, or may be of any suitable special design. The details of the design of the connecting structure 40 form no part of the present invention. The particular connecting structure 40 in the illustrated embodiment of the closure 30 consists of one type of a conventional snap-action type hinge structure 40. With reference to FIGS. 5, 7, and 13, the hinge structure 40 may be conveniently molded from a suitable thermoplastic material to include (1) two spaced-apart diverging elements or membranes 58 that are defined between upper and lower film hinges 59 such that elements 57 connect the lid flange 56 to the base 34, and (2) a central film hinge 61 that connects the lid top cover portion 52 to the base skirt 46.

The above-described snap-action hinge structure 40 permits the lid 36 to be moved between the open and closed positions because the membranes or elements 58 deform elastically as the lid 36 pivots about hinge 61, and the elements 58 move through a dead center position at which each element 58 is maximally deformed. On either side of the dead center position, the deformation of the elements 58 is at least partly reduced, and the lid 36 is thus urged to a stable position at the end of its travel range on that side of the dead center position. Thus, when the lid 36 is in the closed position (FIGS. 4 and 5), it is self-maintained in the closed position. On the other hand, when the lid 36 is open (FIGS. 6 and 7), it is self-maintained in that position to accommodate dispensing of the contents without having to use one's fingers to hold the lid 36 out of the way.

The connecting structure 40 need not be a snap-action hinge. Rather, it could instead be some other type of connecting structure such as a simple hinge that lacks a snap action, a simple strap or tether, etc.

Figure 6:
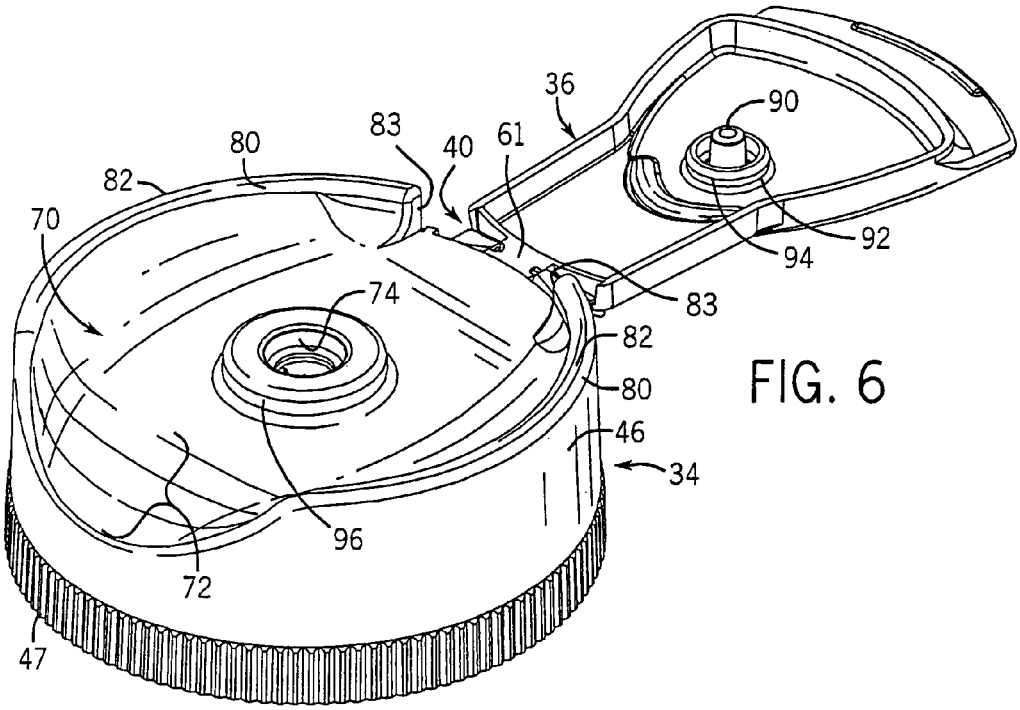
FIG. 6 is an isometric view similar to FIG. 4, but in FIG. 6, the closure is shown with the lid opened (in generally the configuration that the closure would have when it is initially molded from thermoplastic material and removed from the mold without closing the lid)

With reference to FIG. 6, the closure base 34 has a recess 70 that extends in the base 34 from the connecting structure 40 to a front region of the base 34. The front region of the base 34 includes a sloping front surface 72 (FIG. 6) that slopes in a direction toward the base bottom edge 47.

The base 34 defines a dispensing orifice 74 (FIG. 6) in the recess 70 between the connecting structure 40 and the base sloping front surface 72.

Figure 2:
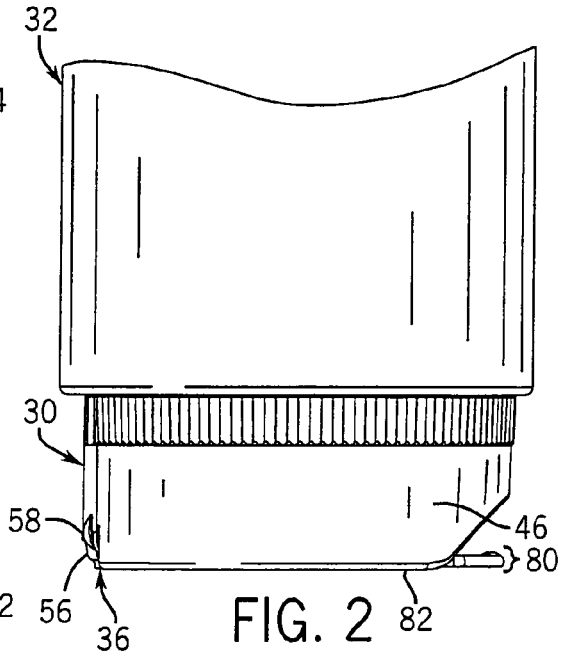
FIG. 2 is a fragmentary, side elevational view of the closure and container shown in FIG. 1, but in FIG. 2 the closure and container are shown in an inverted orientation.
Figure 3:
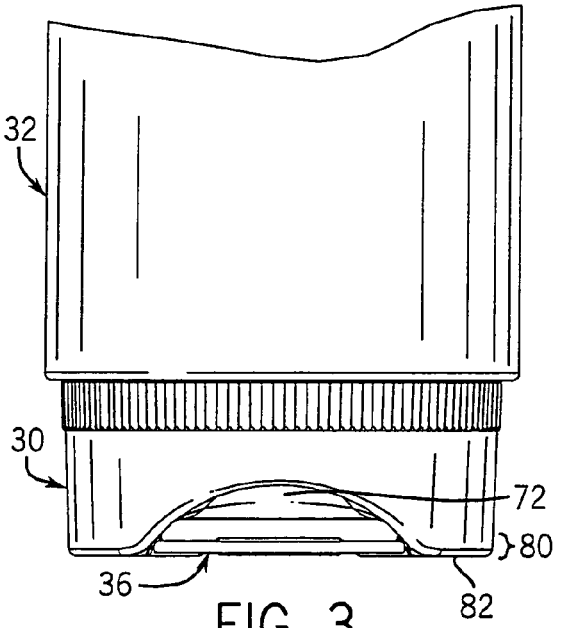
FIG. 3 is a view similar to FIG. 2, but in FIG. 3, the closure and container have been rotated 90 degrees so as to show the front of the closure.

The base 34 has two spaced-apart rim portions 80 (FIG. 6). One of the rim portions 80 is located on one side of the base recess 70 between the connecting structure 40 and the sloping front surface 72, and the other rim portion 80 is located on the other side of the recess 70 between the connecting structure 40 and the sloping front surface 72. Each rim portion 80 has a support surface 82 (FIG. 6) for supporting the closure 30 while the closure 30 is installed on the container 32 when the closure 30 and container 32 are in an inverted orientation (FIGS. 2 and 3).

As can be seen in FIG. 6, the lower region of each rim portion 80 preferably merges with the recess 70 along a curved surface which provides a crevice-free and corner-free configuration that minimizes the likelihood of accumulation of dirt and/or small quantities of the product that may flow or drip onto the closure 30 in the area of the recess 70 when the user dispenses product through the open closure. Also, this smooth configuration can be easily cleaned by the user.

In the illustrated embodiment, the two rim portions 80 each extends from a location forwardly of the dispensing orifice 74 to a location rearwardly beyond the dispensing orifice 74. The rim portions 80 terminate at the front of the closure base 34 in a downward configuration which merges with the lower portion of the sloping front surface 72 as can be seen in FIGS. 6 and 7.

In the embodiment illustrated in FIG. 6, the two rim portions 80 terminate at the rear region of the closure 30 on either side of the connecting structure 40. Specifically, the rim portions 80 at the rear of the closure 30 each terminates in a vertical end 83 (FIGS. 7 and 13) extending upwardly from the recess 70 adjacent the connecting structure membranes 58. However, in an alternate embodiment (not illustrated), the two rim portions 80 at the rear of the closure 30 could either (1) slope downwardly to the recess 70 (in a manner similar to how the rim portions 80 slop downwardly in the front of the closure, or (2) extend in continuous elevated configuration around the back of the closure 30 so that the rim portions 80 would define a single, generally C-shaped structure (as viewed in plan from above).

Figure 4:
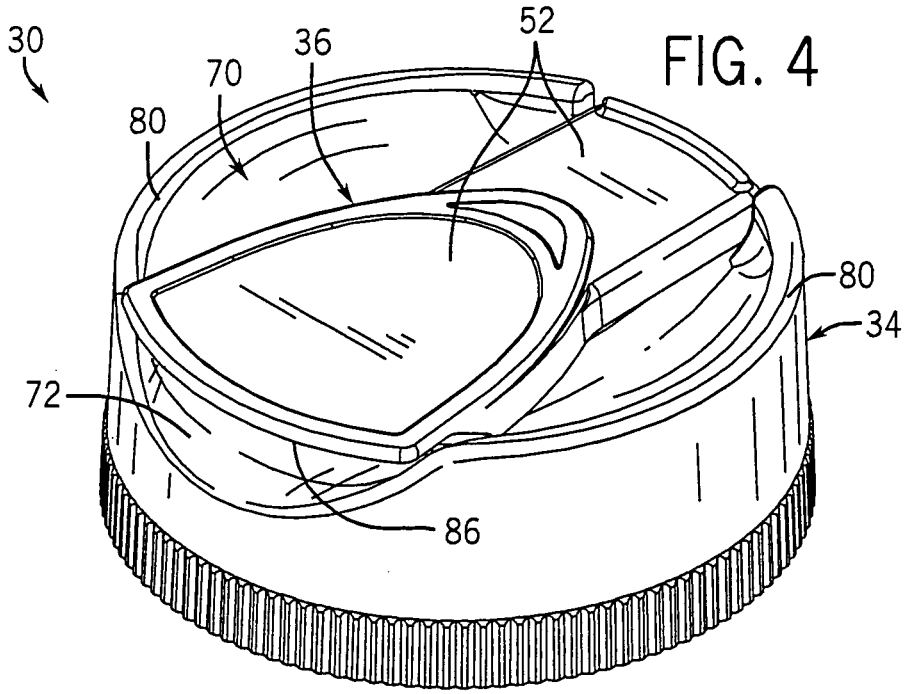
FIG. 4 is an enlarged, isometric view similar to FIG. 1, but FIG. 4 shows the closed closure alone prior to installation on the container.

As can be seen in FIG. 4, the front end of the lid 36 defines a lid finger lift surface 86. As can be seen in FIG. 7, the lift surface 86 extends rearwardly from the front of the lid 36 and curves to merge with the lid peripheral wall or flange 56 at the side of the lid 36. The finger lift surface 86 functions as a surface against which the user can apply a force to lift the lid 36 from the closed position (FIG. 1) to an open position (FIGS. 6 and 7).

When the lid 36 is in the closed position, the lid 36 is positioned in the recess 70. When the closure 30 is installed on a container 32 in an upright orientation with the closed closure 30 at the top of the container 32, the lid 36 positioned such that the following relationships exist:

(1) the top of the lid 36 is below the support surface 82 of each of the two spaced-apart rim portions 80 (see FIG. 10), (2) the lid front end is located rearwardly of the lower end of the base sloping front surface 72 (see FIG. 10), (3) the lid front end finger lift surface extends forwardly over a portion of the base sloping front surface, and (4) a major portion of the lid 36 (i.e., a major portion of the length of the lid 36) is located between the two spaced-apart rim portions 80.

This arrangement of the lid 36 relative to the base 34 when the lid 36 is closed serves to define, among other things, a recessed location of the lid 36 relative to the rim portion support surfaces 82. The difference in the vertical height location of the top of the lid 36 compared to the top of the rim portion support surfaces 82 can be relatively small. For example, in FIG. 8, the top of the lid 36 appears to be almost as high as the support surfaces 82. However, in the enlarged view of FIG. 10, the slight difference in elevation between the higher location of the rim support surfaces 82 and the lower location of the top surface of the lid 36 is more evident. In one preferred embodiment, the top of lid 36 is about 0.010 inch below the top of the rim support surfaces 82.

In an alternate embodiment (not illustrated), the top surface of the closed lid 36 could be lower, if desired, by appropriate design of the lid 36. According to one aspect of the closure embodiment illustrated in FIGS. 1-14, the lid 36 is recessed sufficiently so that the lid 36 is not contacted or engaged by a flat surface (e.g., shelf or counter) upon which the closure 30 and container 32 are disposed in an inverted orientation. This insures that the weight of the package is taken by the closure base support surfaces 82 and not by the lid 36. This avoids subjecting the lid 36 to unnecessary stress, and minimizes the likelihood of the lid 36 being impacted as the user puts the package down in an inverted orientation.

Further, the two spaced-apart rim portions 80 of the closure base 34 protect the lid 36 on either side. Additionally, because the front of the lid 36 is located rearwardly of the lower end of the base sloping front surface 72, the lid lift surface 86 is to some extent protected against inadvertent impacts that might tend to lift or loosen the lid 36.

The lid 36 is relatively small compared to the closure base 34 so that most of the lid 36 is contained within the recess 70 (FIG. 4). The small lid 36 requires less material to provide its structure, thus yielding a manufacturing cost savings.

In addition, the small configuration of the lid 36 relative to the closure base 34 permits a simple latching system to be employed. One optional aspect of the invention permits the closure to be designed to include, if desired, such a simple latching system. Multiple, and/or complex, latching systems are not required. In particular, the underside of the lid 36 can be adapted to be latched to the closure base 34 in the dispensing orifice 74 as next described in detail.

Figure 12:
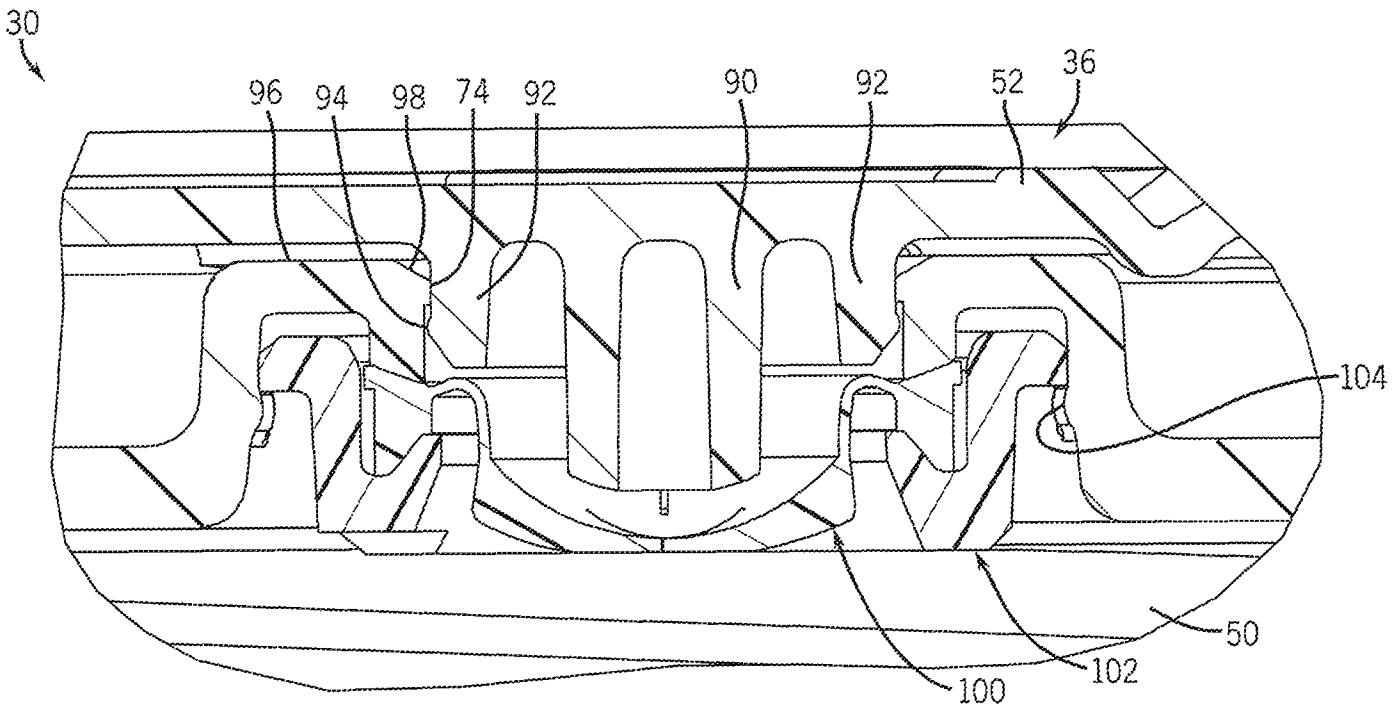
FIG. 12 is an enlarged, fragmentary, cross-sectional view of the portion of the closure within the dashed, dotted circular arc view line 12-12 in FIG. 10.

With reference to FIG. 7, the lid 36 includes a central member 90 projecting outwardly from the inside surface of the lid top cover portion 52, and an annular flange or collar 92 projects outwardly from the lid top cover portion 52 in a concentric relationship with the central member 90. As can be seen in FIGS. 6 and 7, the exterior of the collar 92 defines a radially extending latching bead 94. As can be seen in FIGS. 7 and 12, the closure base dispensing orifice 74 is defined on the inside of a spout 96 projecting upwardly from the closure base 34 in the recess 70. More particularly, the spout 96 defines a laterally inwardly extending, chamfered flange 98 (FIG. 12) which also has a generally vertical, cylindrical surface defining the dispensing orifice 74. When the lid 36 is closed, the lid collar 92 is received in the dispensing orifice 74 (FIG. 12), and the latching bead 94 initially engages the chamfered surface of the spout flange 98 when the lid 36 is pushed downwardly towards its closed position. A temporary, elastic deformation of the lid collar 92, latching bead 94, and/or closure base spout 96 accommodates movement of the lid latching bead 94 downwardly to its lowermost location when the lid 36 is fully closed where the latching bead 94 is spaced somewhat below the closure base chamfered flange 98.

In order to open the lid 36, the lid 36 must be subjected to an upwardly directed force (e.g., from an intentional push by the user's finger or thumb on the lid lift surface 86 (FIG. 10)). The lifting force must be of sufficient magnitude to move the lid latching bead 94 upwardly past the closure base spout chamfered flange 98 (which movement is accommodated again by a temporary, elastic deformation of the portions of the lid 36 and/or base spout 96 in the region of the dispensing orifice 74).

Instead of, or in addition to, employing the lid latching bead 94 and the closure base chamfered flange 98, other latching systems could be provided. For example, one or more members (not illustrated) could be provided in the recess 70 on one or both sides of the lid 36 to project upwardly adjacent the closed lid 36. Cooperating, linear latch beads could be provided on the exterior surface of the lid peripheral wall or flange 56 and on such adjacent latching members.

With reference to the spout 96 illustrated in FIG. 12, the spout 96 is adapted to receive an optional, pressure-actuatable, slit valve 100 that can be maintained in place adjacent the spout orifice 74 with a suitable snap-in valve retainer member 102 wherein such a valve retainer member 102 can be maintained in a snap-fit engagement with an internal annular snap-fit bead 104 on the inside of the spout 96 in such a way that the valve retainer member 102 clamps the periphery of the valve 100 against the spout 96 at the spout orifice 74 and in such a way that the valve slit or slits are aligned with the spout orifice 74. One such conventional valve that may be employed with the closure 30 is the valve that is illustrated and described in the U.S. Pat. No. 7,117,654, wherein the valve is designated generally in that U.S. patent by the reference number 60. The lid central member 90 can function, when the lid 36 is closed, to prevent the valve 100 from opening as a result of increased pressure against the inside of the valve 100 if the package is dropped or squeezed.

If desired, the lid collar latching bead 94 could be modified to define one or more vertical slot vent passages (not illustrated) to permit air to vent back past the re-closed lid 36 and valve 100 and into the container after some amount of liquid product has been dispended from the container so as to equalize the container internal pressure with the external ambient pressure. Such a vent passage or passages (not illustrated) could also have another function during assembly of the illustrated embodiment of the closure 30. Specifically, after the thermoplastic material is molded to form the open closure, and after the closure 30 is removed from the mold and the lid 36 closed, then the manufacturer installs the valve 100 into the closure 30 from the open bottom end of the closed closure 30. This is accomplished by pushing the retainer member 102 and valve 100 inwardly through the bottom of the closure 30. If there were no vent passages defined in the lid collar latch bead 94, then air could become compressed between the valve 100 and the closed orifice 74 of the closure base 34 under the closed lid 36, and the compressed air could interfere with the proper seating of the valve 100 in the closure base 34—depending on the tolerance of the various relevant portions of the closure and the speed of the assembly process. The proposed vent passage or passages would allow the air (that is being compressed by the inwardly moving valve 100 during the installation process) to flow upwardly through the vent passages to the region above the closure base spout 96 from where the air can leak out through the clearances around the hinge link 60 and membranes 58 so as to prevent the pressure from building up inside the closure 30 to a level that would inhibit proper seating and installation of the valve 100.

The closure 30 of the present invention may be used with or without a valve, and the detailed design and operation of such a valve form no part of the present invention.

The shape of the lid 36 could be altered from the particularly aesthetically interesting shape illustrated in FIGS. 1-14. For example, the lid 36 could instead have other aesthetically interesting designs, such as an oval shape, or circular shape, or low dome shape, or some other shape. Also, the shape of the closure base 34 could be different. For example, rather than the particularly aesthetically interesting shape of the base 34 illustrated in FIGS. 1-14, the base could have an oval shape and/or a deeper recess. Also, the front to rear distance of the base could be less than the width. Also, the height of the base could be increased or decreased.

It will be readily apparent from the foregoing detailed description of the invention and from the illustrations thereof that numerous variations and modifications may be effected without departing from the true spirit and scope of the novel concepts or principles of this invention.

What is claimed is:

1. A closure for a container that has an opening to its interior where a product may be stored, said closure comprising:

(I) a base that defines at least one dispensing orifice for communicating with a container opening, and that is either (A) separate from a container for being attached to a container at its opening, or (B) a structure formed as a unitary portion of a container at its opening;

(II) a lid;

(III) a connecting structure connecting said lid to said base for movement between (A) a dosed position occluding said dispensing orifice, and (B) an open position spaced from said dispensing orifice; and wherein said base (1) has a recess that extends in said base from said connecting structure to a front region of said base, (2) defines a sloping front surface that (a) is located at the front region of said base, (b) slopes continuously to a lower end in the direction downwardly away from said recess, and (c) defines a continuous convex curve when said sloping front surface is viewed externally from above by a user of said closure, (3) defines said dispensing orifice between said connecting structure and said base sloping front surface, and (4) has two spaced-apart rim portions, one of said rim portions located on one side of said base recess between said connecting structure and said sloping front surface, and the other of said rim portions located on the other side of said recess between said connecting structure and said sloping front surface, each said rim portion having a support surface for supporting said closure on a container when said closure and container are in an inverted orientation; and said lid (1) has a rear end attached to said connecting structure, (2) has a front end defining a lid finger lift surface against which a user can apply a force to lift said lid, and (3) is positioned in said recess when said closure is positioned on a container in an upright orientation with said closure at the top of a container and with said lid in said dosed portion so that (a) said lid is below said support surface of each said two spaced-apart rim portions of said base, (b) said lid front end is located rearwardly of at least said lower end of said base continuously and convexly sloping front surface, and (c) a major portion of said lid is located laterally between said two spaced-apart rim portions of said base.

2. The closure in accordance with claim 1 in which said closure is a separately manufactured component that can be subsequently attached to a container around its opening.

3. The closure in accordance with claim 1 in which said lid finger lift surface is located generally 180 degrees from said connecting structure that connects said lid to said base.

4. The closure in accordance with claim 1 in which each said rim portion has a lower region merging with said recess along a curved surface.

5. The closure in accordance with claim 1 in which each of said two spaced-apart rim portions terminates adjacent said connecting structure.

6. The closure in accordance with claim 1 in which each of said two spaced-apart rim portions extends rearwardly along said recess from a location forwardly of said dispensing orifice toward said connecting structure and to a location rearwardly beyond said dispensing orifice.

7. The closure in accordance with claim 1 in which said finger lift surface extends forwardly over a portion of said base sloping front surface.

8. The closure in accordance with claim 1 in which said lid front end is located laterally between said two spaced-apart rim portions of said base.

9. The closure in accordance with claim 1 in which each of said rim portions terminates in a vertical end adjacent said connecting structure.

* * * * *

UNITED STATES PATENT AND TRADEMARK OFFICE

CERTIFICATE OF CORRECTION

PATENT NO. : 9,073,673 B2
APPLICATION NO. : 13/639603
DATED : July 7, 2015
INVENTOR(S) : Timothy M. Mazurkiewicz et al.

It is certified that error appears in the above-identified patent and that said Letters Patent is hereby corrected as shown below:

In The Claims

Column 10, line 3, "dosed" should be -- closed --; and
Column 10, line 33, "dosed portion" should be -- closed position --.

Signed and Sealed this
Twenty-fourth Day of November, 2015

Michelle K. Lee

Michelle K. Lee
*Director of the United States Patent and Trademark Office*